US006092774A

United States Patent [19]

Choy

[11] Patent Number: 6,092,774

[45] Date of Patent: Jul. 25, 2000

[54] KEYBOARD POSITIONING SYSTEM

[75] Inventor: Andrew Lee Choy, San Francisco, Calif.

[73] Assignee: Acco Brands, Inc., San Mateo, Calif.

[21] Appl. No.: 09/198,086

[22] Filed: Nov. 23, 1998

[51] Int. Cl.[7] ..... A47F 5/00; F16M 11/00; F16M 11/16

[52] U.S. Cl. ..... 248/298.1; 248/176.1; 248/188; 248/918

[58] Field of Search ..... 248/176.1, 176.3, 248/188, 286.1, 298.1, 558, 639, 676, 917, 918, 919; 108/147.12, 147.13

[56] References Cited

U.S. PATENT DOCUMENTS

| | | | |
|---|---|---|---|
| 4,063,830 | 12/1977 | Ban | 403/3 |
| 4,157,876 | 6/1979 | DiGiulio | 403/90 |
| 4,201,427 | 5/1980 | Orr | 312/21 |
| 4,320,884 | 3/1982 | Leo | 248/276 |
| 4,379,429 | 4/1983 | Gubbe et al. | 108/5 |
| 4,384,532 | 5/1983 | Staff | 108/72 |
| 4,402,481 | 9/1983 | Sasaki | 248/276 |
| 4,431,329 | 2/1984 | Baitella | 403/55 |
| 4,453,687 | 6/1984 | Sweere | 248/183 |
| 4,568,052 | 2/1986 | Solomon et al. | 248/281.1 |
| 4,573,655 | 3/1986 | Vulic | 248/278 |
| 4,585,195 | 4/1986 | McFadden | 248/118 |
| 4,616,798 | 10/1986 | Smeenge et al. | 248/281.1 |
| 4,625,657 | 12/1986 | Little et al. | 108/93 |
| 4,632,349 | 12/1986 | Anstey | 248/281.1 |
| 4,645,155 | 2/1987 | Eldon et al. | 248/278 |
| 4,657,214 | 4/1987 | Foster | 248/176.1 |
| 4,691,888 | 9/1987 | Cotterill | 248/284 |
| 4,706,919 | 11/1987 | Soberalski et al. | 248/281.1 |
| 4,717,112 | 1/1988 | Pirkle | 248/639 |
| 4,736,689 | 4/1988 | Stanko | 108/5 |
| 4,901,972 | 2/1990 | Judd et al. | 248/639 |
| 4,931,978 | 6/1990 | Drake et al. | 364/680 |
| 5,031,867 | 7/1991 | Cotterill | 248/281.1 |
| 5,062,609 | 11/1991 | Hames et al. | 248/676 |
| 5,161,760 | 11/1992 | Terbrack | 248/118 |
| 5,176,351 | 1/1993 | Moore | 248/286 |
| 5,242,139 | 9/1993 | Aldrich | 248/118 |
| 5,257,767 | 11/1993 | McConnell | 248/284 |
| 5,292,097 | 3/1994 | Russell | 248/281.1 |
| 5,314,152 | 5/1994 | Troy et al. | 248/146 |
| 5,443,237 | 8/1995 | Stadtmauer | 248/441.1 |
| 5,483,898 | 1/1996 | Seidl | 108/3 |
| 5,490,466 | 2/1996 | Diffrient | 108/96 |
| 5,533,820 | 7/1996 | Ambrose | 400/472 |
| 5,582,375 | 12/1996 | Martin | 248/118.3 |
| 5,584,596 | 12/1996 | Greene | 403/55 |
| 5,588,375 | 12/1996 | Cotterill | 108/102 |
| 5,595,428 | 1/1997 | Huang | 312/223.3 |
| 5,626,323 | 5/1997 | Lechman et al. | 248/286.1 |

*Primary Examiner*—Anita M. King
*Assistant Examiner*—David Heisey
*Attorney, Agent, or Firm*—Townsend and Townsend and Crew LLP

[57] ABSTRACT

A keyboard positioning apparatus for supporting a keyboard tray does not require complex mounting mechanisms or drilling holes in the support base such as a desk. A specific embodiment employs a desktop apparatus that includes a tray guide supported on the base and having a pair of spaced guide members. A tray rail has a pair of rail members each slidably engaging one of the pair of spaced guide members to slide between a front and a rear of the rail members. Each rail member has at least two rollers for providing rolling motion of the rail members on the base. The tray is coupled to the tray rail for supporting a keyboard. Another specific embodiment employs a tool-less, adjustable, out-board clamping mechanism for releasably mounting the apparatus underneath the desk without requiring holes to be drilled in the base. The apparatus includes a pair of spaced brackets and a pair of clamps releasably coupling the pair of spaced brackets nondestructively underneath the base. A pair of spaced slide members are each coupled to one of the spaced brackets. The keyboard tray has two sides each slidably coupled to one of the spaced slide members for supporting a keyboard to move in and out beneath the base. The apparatus of the present invention can be easily adapted nondestructively to a variety of support bases such as desks. The apparatus are easy to assemble and can be moved easily without destruction to the desks or similar support bases.

10 Claims, 4 Drawing Sheets

KEYBOARD POSITIONING SYSTEM

BACKGROUND OF THE INVENTION

Keyboard positioning apparatus are commonly used to support keyboards associated with computer terminals and the like. The positioning apparatus is typically mounted to a desk and includes a keyboard support tray which can be pulled out from underneath the desk.

Conventional positioning apparatus employ fasteners for attachment beneath the desk. The use of fasteners such as screws requires holes to be drilled, and limits the apparatus to certain support surfaces that can receive the fasteners. It generally precludes the use of glass desk tops, for example. In addition, the attachment procedure can be complicated and time-consuming, and requires the use of tools. It is also inconvenient to change the location of attachment for the apparatus, because the fasteners are not readily removable. Although clamps can be used in place of fasteners, they protrude under the desk with a substantial length and can block the movement of the keyboard on the support tray when it is slid under the desk.

SUMMARY OF THE INVENTION

The present invention is directed to a keyboard positioning system which avoids the problems and disadvantages of the prior art. This goal is accomplished by providing keyboard positioning apparatus that do not require complex mounting mechanisms or drilling holes in the desk. A specific embodiment employs an apparatus that is supported on top of the desk. Another specific embodiment employs a tool-less, adjustable, out-board clamping mechanism for releasably mounting the apparatus to the desk without requiring holes to be drilled in the base. As a result, the apparatus of the present invention can be easily adapted to a variety of support bases such as desks. The apparatus are easy to assemble and can be moved easily without destruction to the desks or similar support bases.

According to an aspect of the present invention, an apparatus for supporting a keyboard relative to a base comprises a tray guide supported on the base, the tray guide having a pair of spaced guide members. A tray rail has a pair of rail members each slidably engaging one of the pair of spaced guide members to slide between a front and a rear of the rail members. Each rail member has at least two rollers for providing rolling motion of the rail members on the base. A tray is coupled to the tray rail for supporting a keyboard. The tray guide is supported for providing sliding of the tray rail to at least partially overhang an edge of the base.

According to another aspect of the invention, an apparatus for supporting a keyboard relative to a base comprises a keyboard tray having a plurality of rollers for providing rolling contact with the base and a pair of spaced rails disposed near two sides of the tray and extending at least substantially parallel to one another. A mechanism is positioned on the base for providing sliding movement of the pair of rails relative to the base to support the keyboard tray between a position with the rollers resting on the base and another position with the keyboard tray overhanging at least partially over an edge of the base.

In accordance with another aspect of the invention, an apparatus for supporting a keyboard relative to a base comprises a pair of spaced brackets. A pair of clamps releasably couple the pair of spaced brackets nondestructively underneath the base. A pair of spaced slide members are each coupled to one of the spaced brackets. A tray has two sides each slidably coupled to one of the spaced slide members for supporting a keyboard to move in and out beneath the base.

In accordance with another aspect of the invention, an apparatus for supporting a keyboard relative to a base comprises a keyboard tray having two sides each housing a plurality of rolling members and a pair of spaced brackets. A pair of clamps releasably couple the pair of spaced brackets nondestructively underneath the base adjacent and external to the two sides of the keyboard tray. A mechanism is coupled to the spaced brackets for providing sliding support of the plurality of rolling members housed in the two sides of the keyboard tray.

BRIEF DESCRIPTION OF THE DRAWINGS

The preferred embodiments of this invention, illustrating all their features, will now be discussed in detail. These embodiments depict the novel and nonobvious keyboard positioning system of this invention shown in the accompanying drawings, which are included for illustrative purposes only. These drawings include the following figures, with like numerals indicating like parts.

DESCRIPTION OF THE SPECIFIC EMBODIMENTS

Figure 1:
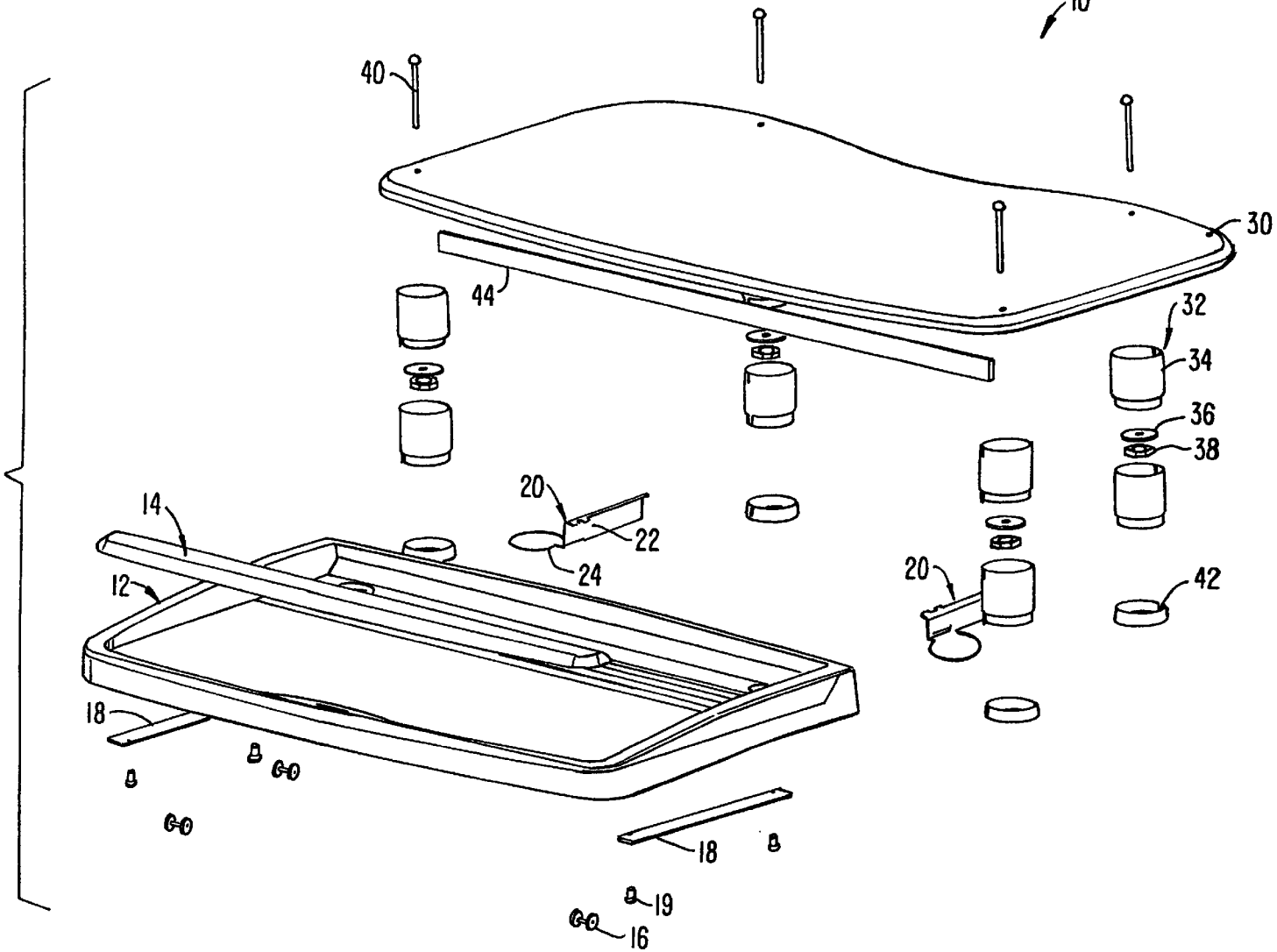
FIG. 1 is an exploded perspective view of a keyboard positioning system in accordance with an embodiment of the present invention.

FIG. 1 shows a keyboard positioning system 10 which includes a keyboard tray 12 for supporting a keyboard (not shown). The tray 12 typically is substantially rectangular, and preferably is large enough to hold a mouse as well as a keyboard, and includes openings in the rear portion for accommodating cables for the keyboard and mouse (not shown). The tray 12 includes an optional keyboard pad 14 that may be made of a variety of materials such as foam or a gel for supporting the user's wrists, and may have different shapes. The pad 14 is disposed in the front portion of the tray 12 and typically extends substantially across the length of the tray 12. The tray 12 has a plurality of rollers 16 at the bottom to provide rolling support of the tray 12 relative to the surface of a base such as a desktop or the like (not shown). In FIG. 1, the tray 12 has four rollers 16 spaced near its four corners. The tray 12 further includes a pair of spaced tray rail members 18 that are at least substantially parallel to one another and extend from the front to the back of the tray 12. The rail members 18 are typically straight and substantially planar. The rail members 18 are typically mounted near or at the bottom of the tray 12 along the right and left sides thereof. In the embodiment shown, railmount screws 19 are used to mount the rail members 18. In a specific embodiment, the tray 12 has two pairs of rollers 16 and each pair of rollers 16 are attached near the front and back ends of each tray rail member 18.

A pair of tray guide members 20 are supported on the base to provide guiding support for the rail members 18. The tray guide members 20 serve as tracks on which the rail members 18 slide freely back and forth to allow the tray 12 to roll in and out on the base. Thus, the guide members 20 have the substantially vertical configuration with upper constraints 22 to provide sliding support for the rail members 18. The rails members 18 include protrusions or stops (not shown) near the front and back ends to limit the range of sliding movement of the rail members 18 relative to the guide members 20 to prevent disengagement between them. The guide bottom 24 of each guide member 20 is supported on the base to have a substantially fixed position for constraining the movement of the tray 12. The embodiment shown in FIG. 1 advantageously fixes the position of the guide members 20 relative to the base without requiring any permanent mounting of the guide bottoms 24 to the base or drilling holes in the base, as discussed below.

As shown in FIG. 1, the keyboard positioning system 10 includes a platform 30 which is used, for example, for supporting a monitor or display, a computer terminal, and/or the like. The platform 30 typically has a planar, substantially rectangular shape, and is supported on the base by a plurality of legs 32. In this embodiment, there are four legs 32 disposed near the four comers of the platform 30. The legs 32 are desirably adjustable in height, for instance, by using stackable leg portions 34. In this embodiment, each leg 32 has two substantially circular cylindrical leg portions 34 that are stacked together. Disposed between the leg portions 23 of each leg 32 are a leg washer 36 and a leg nut 38 that cooperate with a leg screw 40 for attaching the leg 32 to the platform 30. Each leg 32 further includes a leg pad 42 connected at the bottom which prevents scratching the surface of the base. In this embodiment, the tray guide members 20 are conveniently coupled to the pair of legs 32 at the front portion of the platform 30. In this specific embodiment, the guide bottoms 24 of the guide members 20 are shaped for easy attachment near the bottom of the legs 32, for instance, between the leg portions 34 and the leg pads 42. The weight of the platform 30 as well as the weight of any equipment (such as computer terminal and monitor) placed over the platform 30 is used to fix the positions of the tray guide members 20 to provide stable support for the tray rail members 18 and the tray 12 without the need for complicated or destructive mounting to the base.

The components of the keyboard positioning system 10 are typically made of plastic or the like that can be made by molding or similar methods. The system 10 will be typically light in weight. If additional structural or flexural strength is needed for the platform 30, particularly along its length, for supporting heavy equipment thereon, one or more support members or beams 44 are attached underneath the platform 30 to extend substantially across the length of the platform 30. The support members 44 may also be oriented differently, such as diagonally across the platform 30.

Once assembled, the platform 30 and the tray guide members 20 will be at least substantially fixed in position on the base. The tray 12 slides freely relative to the tray guide members 20 via the tray rail members 18 in and out below the platform 30, which is sufficiently tall to allow the tray 12 and keyboard (not shown) to slide thereunder. Because of the stable support provided by the tray guide members 20, the tray 12 at least partially overhangs an edge of the base when it is pulled out from under the platform 30 without toppling the platform 30 or otherwise creating any instability of the system 10. The tray guide member 20 form a cantilever support for the tray rail members 18 and tray 12 in the overhang position under the weight of the platform 30 and any equipment disposed thereon. Depending on the weight of the tray 12 and keyboard, stronger materials (such as metals or composites) are used for making the guide members 20 and/or rail members 18 to prevent breakage. This system 10 is disposed completely over the base without the need for mounting to the base. As a result, the system 10 is easily adapted to any base surface, such as desktops without complicated mounting hardware or procedure.

Figure 2:
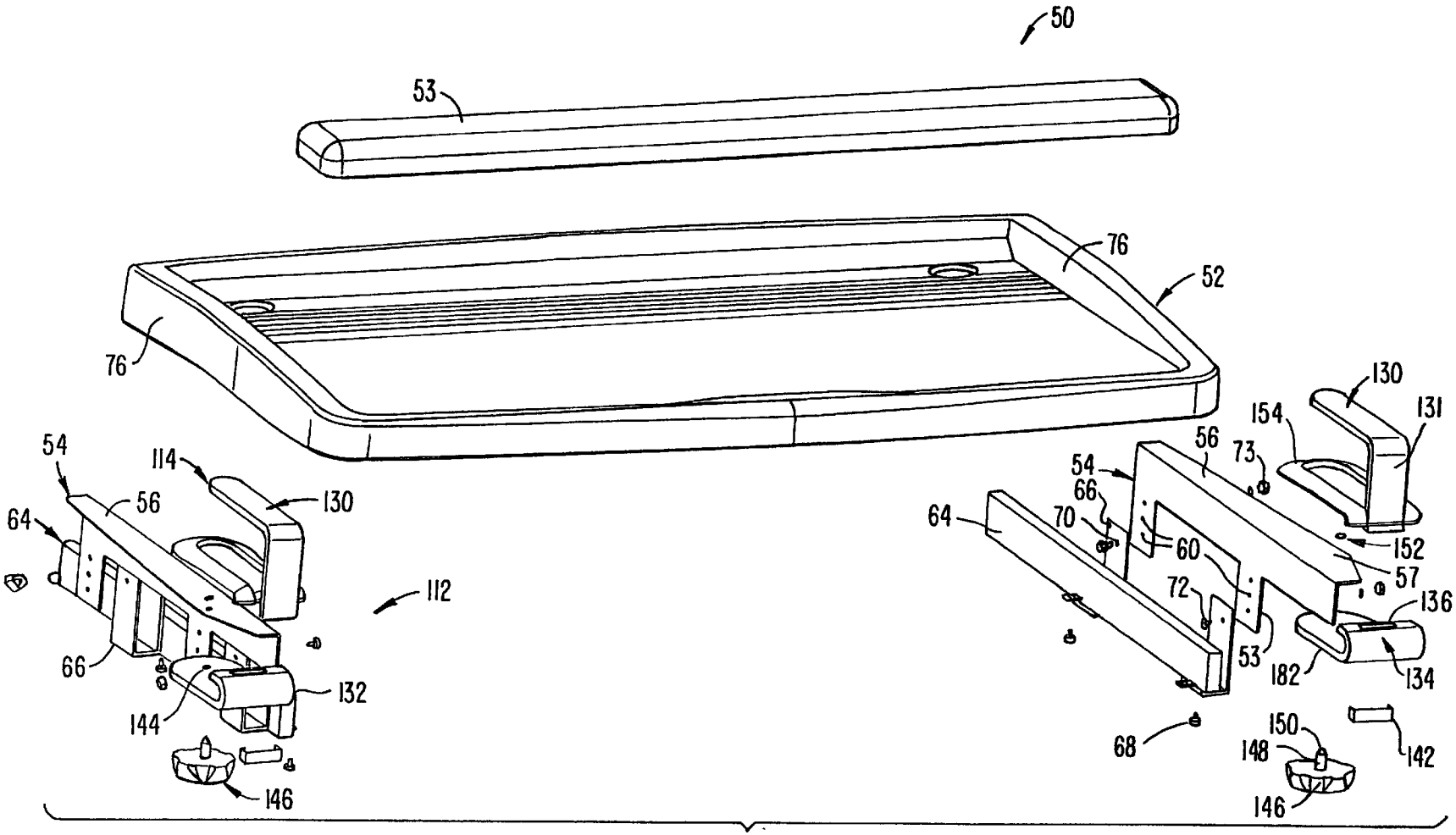
FIG. 2 is a partially exploded perspective view of a keyboard positioning system in accordance with another embodiment of the present invention.

In the second embodiment shown in FIG. 2, a keyboard positioning system 50 employs a tool-less mounting mechanism for releasably supporting a keyboard tray 52 underneath a base (not shown) without requiring holes to be drilled in the base. The keyboard tray 52 also has an optional pad 53 for supporting the user's wrists. The system 50 includes a pair of spaced support brackets 54 that are disposed on left and right sides of the keyboard tray 52 and typically are substantially parallel to one another. The brackets 54 typically are substantially L-shaped and have upper surfaces 56 that are mounted to the bottom of the base via upper apertures 57, as discussed in more detail below. Each bracket 54 has at least two legs 58 with a plurality of spaced apertures 60. The bracket apertures 60 in the embodiment shown are substantially vertically spaced. The system 50 further includes a pair of slide brackets or members 62 each having a slide 64 coupled to at least a pair of angles 66 via angle fasteners 68 or similar means. Each angle 66 has an angle aperture 68. In the embodiment, the slides 64 are at least substantially horizontal and parallel to one another. To couple each slide member 62 to the respective bracket 54, a pair of bracket fasteners such as screws 72 extend through the angle apertures 70 and the bracket apertures 60 to secure the connection with washers and nuts 73. Because of the plurality of spaced bracket apertures 60 defining different heights, the height of the slide members 62 relative to the base is set by selecting the appropriate bracket apertures 60 for attachment.

Figure 3:
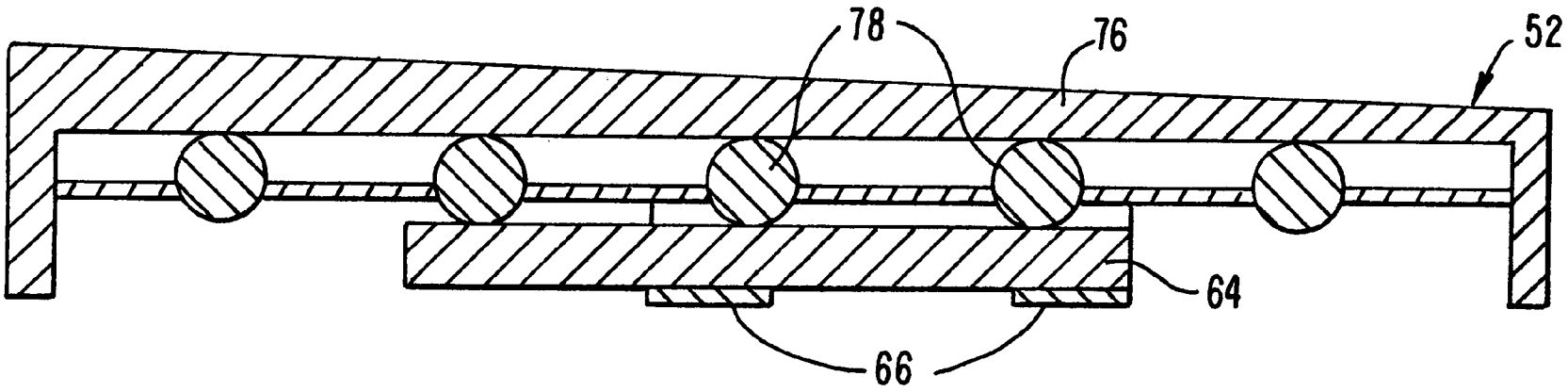
FIG. 3 is a cross-sectional view of a sliding mechanism of the keyboard positioning system of FIG. 2.

The embodiment of the system 10 of FIG. 2 employs a ball bearing slide mechanism such as those used in drawers to provide sliding between the tray 52 and the slide members 62. The parallel sides 76 of the tray 52 serve as bearing housings for housing a plurality of ball bearings 78, as best seen in FIG. 3. The slides 76 are sufficiently long to provide stable, balanced support for the tray 52, but remains relatively short to allow the full range of in and out movement of the tray 52 underneath the base. The ball bearing slide mechanism facilitates easy and quick installation of the system 10. It is understood that other slide mechanisms known in the art may be adapted to provide sliding between the tray 52 and the slides 76.

Figure 5:
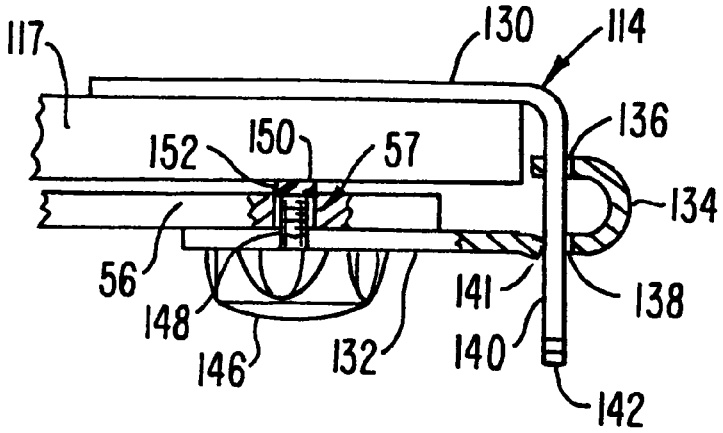
FIG. 5 is a schematic elevational view of a clamped portion of the assembled keyboard positioning system of FIG. 2.

As shown in FIG. 2, the system 50 employs a tool-less clamping mechanism 112 having a pair of clamps 114 for releasably mounting the upper portions 56 of the support brackets 54 to the bottom surface of a support base 117 (see FIG. 5). The pair of clamps 114 are spaced across the length of the tray 52, and are disposed just external to the two sides 76 of the tray 52. The clamping mechanism 112 having this characteristic is referred to as an out-board mechanism.

Figure 4:
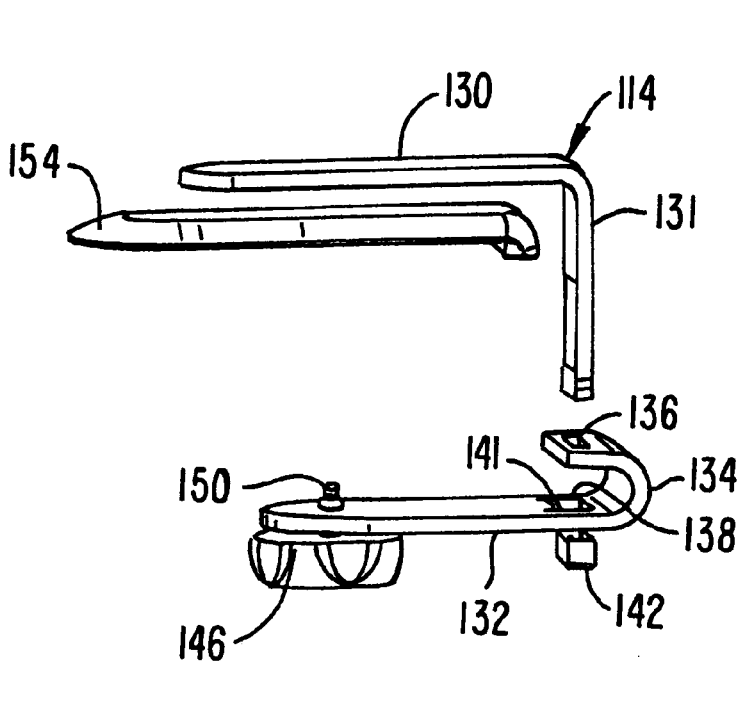
FIG. 4 is a close-up exploded perspective view of a clamp of the keyboard positioning system of FIG. 2.

Referring to FIGS. 2 and 4, an example of a clamp 114 of the clamping mechanism 112 includes a clamp top 130 slidably coupled to a clamp bottom 132. The clamp top 130 and clamp bottom 132 are typically disposed horizontally. The clamp top 130 is formed, desirably into a general L-shape, with a clamp slide portion 131 which extends downward to the clamp bottom 132. In this embodiment, the clamp bottom 132 includes a folded portion 134 having an upper opening 136 disposed above and substantially aligned with an engagement opening 138 in the lower portion of the clamp bottom 132. The clamp slide portion 131 of the clamp top 130 extends slidably through the pair of openings 136, 138 to adjust a clamp spacing between the clamp top 130 and clamp bottom 132. Because of the approximately 90o bend in the clamp top 130, the sliding displacement between the clamp top 130 and clamp bottom 132 is substantially vertical. Other embodiments may include a sloped slide portion 131 so that the displacement is slanted. The clamp slide portion 131 is engageable with the clamp bottom 132 to lock into a selected clamp spacing between the clamp top 130 and clamp bottom 132. In this embodiment, the clamp slide portion 131 has a toothed or corrugated surface 140 which is engageable with an angled engagement edge 141 of the engagement opening 138 of the clamp bottom 132 (as best seen in FIG. 4).

A clamp cap 142 is preferably provided at the end of the clamp slide portion 131. The clamp cap 142 has a size that prevents it from passing through the openings 136, 138. When assembled, the clamp cap 142 prevents the clamp bottom 132 from slipping off the clamp top 130. The clamp bottom 132 further includes a threaded aperture 144 for receiving a clamp knob 146. The clamp knob 146 has a screw portion 148 that is adjustably coupled with the threaded aperture 144 and has a tip 150 that protrudes through the aperture 144 into the clamp spacing. The tip 150 fits through the upper aperture 57 of the upper portion 56 and cooperates with a clip 152 to capture and secure the connection between the knob 146 and the upper portion 56 of the bracket 54. The clip 152 may be an E-style circle clip, a cotter pin, or the like. By securing the connection between the knob 146 (with the clamp bottom 132) to the upper portion 56, it is much easier to assemble the clamp 114 and mount the bracket 54 to the base 117 by a single person.

Referring to FIGS. 2, 4, and 5, the clamp slide portion 131 of the clamp top 130 is inserted through the openings 136, 138 of the folded portion 134 of the clamp bottom 132. During insertion, the clamp slide portion 131 will generally need to be tilted slightly or so formed that the angled edge 141 of the opening 138 does not get caught in the corrugations of the corrugated surface 140. The engagement opening 138 is sufficiently large to allow the clamp slide portion 131 to pass through in a tilted or bent manner. The folded portion 134 advantageously provides a stable and precise guide for the clamp slide portion 131 to facilitate smooth, accurate adjustment of the clamp spacing. The clamp top 130 and clamp bottom 132 are brought sufficiently close together to clamp the upper portion 56 and base 117 therebetween, as best seen in FIG. 5. An optional clamp foot 154 may be provided between the clamp top 130 and the support base 117. The clamp foot 154 preferably has a larger surface area than the clamp top 130 to provide more stable clamping and distribute the clamp forces more evenly on the base 117.

The engagement between the corrugated surface 140 of the clamp top 130 and engagement edge 141 of the clamp bottom 132 is releasable. To securely clamp the upper portion 56 to the base 117, the clamp knob 146 is tightened toward the base 117 until the tip 150 with the clip 152 bears against the bottom surface of the base 117, as best seen in FIG. 5. This clamp knob 146 exerts a force on the clamp bottom 132 to ensure a secure engagement between the corrugated surface 140 and the angled edge 141. Because the clamp top 130 is slidably coupled to the clamp bottom 132 via the clamp slide portion 131 to accommodate different clamp spacings, the clamp knob 146 can be very short. The short clamp knob 146 protects the clamp 114 by limiting torque forces it sustains.

The clamping mechanism 112 is easily adjustable by releasing the clamp knob 146. In addition, because the clamp top 130 and clamp bottom 132 of each clamp 114 are free to swivel laterally, the pair of clamps 114 can be oriented nonparallel to one another to facilitate corner mounting to a corner rather than a straight edge of the support base 117. The clamping mechanism 112 does not require holes to be drilled in the base 117. Installation of the clamping mechanism 112 is simple and fast, and can be performed by one person without any tools. The components of the system 50 can be made of a variety of materials, such as plastics, metals, and the like.

The above-described arrangements of apparatus and methods are merely illustrative of applications of the principles of this invention and many other embodiments and modifications may be made without departing from the spirit and scope of the invention as defined in the claims. For instance, although FIG. 1 shows wheel-like rollers 16, it is understood that other types of rollers such as spherically shaped rollers can be used instead. Other mounting devices can be used to mount the rail members 18. The guide members 20 can take on a variety of shapes other than the substantially vertical configuration shown in FIG. 1. The bracket apertures 60 in the embodiment shown in FIG. 2 can be inclined at an angle instead. Alternative ways of securing the knob 146 to the upper portion 56 such as threading the upper aperture 57 to threadingly engage the screw portion 148 of the knob 146 can be used instead of a clip.

What is claimed is:

1. An apparatus for supporting a keyboard relative to a base, the apparatus comprising:

a tray guide adapted to be supported on the base, the tray guide having a pair of spaced guide members;

a tray rail having a pair of rail members each slidably engaging one of the pair of spaced guide members to slide relative to the guide member between a front and a rear of the rail member, each rail member having at least two rollers configured to be disposed between the rail member and the base for rolling on the base to provide rolling motion of the rail members on the base; and a tray coupled to the tray rail for supporting a keyboard;

wherein the tray guide is supported for providing sliding of the tray rail to at least partially overhang an edge of the base, wherein the pair of spaced guide members are substantially stationary when the pair of rail members slide relative to the guide members between the front and the rear of the rail members.

2. The apparatus of claim 1, wherein the tray includes a keyboard pad extending substantially across a length of the tray in a front portion thereof.

3. The apparatus of claim 1, further comprising a platform configured to be disposed on the base.

4. The apparatus of claim 3, wherein the platform includes a plurality of spaced legs resting on the base, the pair of spaced guide members being coupled to a pair of the legs.

5. The apparatus of claim 4, wherein the legs of the platform are adjustable in height.

6. The apparatus of claim 5, wherein each leg includes at least one stackable leg portion that is attachable to additional stackable leg portions to adjust the height of the leg.

7. The apparatus of claim 6, wherein each leg includes a leg pad bottom configured to rest on the base.

8. The apparatus of claim 3, wherein the platform includes at least one reinforcing member extending substantially across a length thereof.

9. The apparatus of claim 3, wherein the platform includes at least one reinforcing member extending between a pair of the legs spaced along a length of the platform.

10. The apparatus of claim 1, wherein the pair of spaced guide members are substantially shorter in length than the pair of rail members.

* * * * *